US008128581B2

(12) United States Patent
Potter

(10) Patent No.: US 8,128,581 B2
(45) Date of Patent: Mar. 6, 2012

(54) VACUUM APPARATUS AND METHOD FOR TREATING SORES

(76) Inventor: Christopher Potter, Robinsville, NJ (US)

( * ) Notice: Subject to any disclaimer, the term of this patent is extended or adjusted under 35 U.S.C. 154(b) by 1007 days.

(21) Appl. No.: 11/293,260

(22) Filed: Dec. 5, 2005

(65) Prior Publication Data

US 2006/0155219 A1 Jul. 13, 2006

Related U.S. Application Data

(60) Provisional application No. 60/642,132, filed on Jan. 7, 2005.

(51) Int. Cl.
*A61H 7/00* (2006.01)

(52) U.S. Cl. ..... 601/7

(58) Field of Classification Search ..... 601/6, 7, 601/10–12, 18
See application file for complete search history.

(56) References Cited

U.S. PATENT DOCUMENTS

| | | | | |
|---|---|---|---|---|
| 2,120,872 | A | 6/1938 | Seward | |
| 4,111,192 | A * | 9/1978 | Wu | 601/14 |
| 4,212,204 | A | 7/1980 | St. Amand | |
| 4,309,989 | A * | 1/1982 | Fahim | 601/2 |
| 4,646,725 | A * | 3/1987 | Moasser | 601/2 |
| 4,847,283 | A * | 7/1989 | Harendza-Harinxma | 514/415 |
| 5,701,917 | A * | 12/1997 | Khouri | 128/897 |
| 5,823,184 | A * | 10/1998 | Gross | 128/204.18 |
| 5,902,293 | A * | 5/1999 | Liu | 604/313 |
| 6,125,843 | A | 10/2000 | Gold et al. | |
| 6,161,548 | A * | 12/2000 | Tu | 128/898 |
| 6,322,583 | B1 * | 11/2001 | Tu et al. | 607/96 |
| 6,638,240 | B2 * | 10/2003 | Fassuliotis | 604/27 |
| 2003/0055475 | A1 * | 3/2003 | Rousmaniere | 607/114 |

FOREIGN PATENT DOCUMENTS

| | | |
|---|---|---|
| WO | WO0145546 | 6/2001 |

* cited by examiner

*Primary Examiner* — Kristen Matter
(74) *Attorney, Agent, or Firm* — Cahn & Samuels, LLP

(57) ABSTRACT

A device and method for the treatment of mouth sores or ulcers, such as canker sores. The device includes a vacuum bulb connected to a treatment tip via a fluid-tight conduit. The device allows for a vacuum to be applied to the area of a canker sore by positioning of the tip and actuation of the vacuum bulb. Through gentle application of a vacuum to the area afflicted with a canker sore, the sensitivity of the afflicted area is diminished and the healing process is significantly improved. The device preferably includes disposable applicator tips.

1 Claim, 7 Drawing Sheets

VACUUM APPARATUS AND METHOD FOR TREATING SORES

I. CROSS REFERENCE TO RELATED APPLICATION

This application claims the benefit of 35 U.S.C. §119(e) to U.S. Provisional Application No. 60/642,132, filed on Jan. 7, 2005, which is hereby incorporated by reference in its entirety.

II. FIELD OF THE INVENTION

The present invention relates to a device for healing ulcers and sores, and more particularly, to a vacuum device that applies suction to a sore, such as a canker sore, to alleviate pain and expedite the healing process.

III. BACKGROUND OF THE INVENTION

Recurrent canker sores afflict about 20 percent of the general population. The medical term for the sores is aphthous stomatitis.

Canker sores are usually found in the mouth, including the tongue or the inside linings of the lips and cheeks. They begin as small oval or round reddish swellings, which usually burst within a day. The ruptured sores are covered by a thin white or yellow membrane and edged by a red halo. Generally, they heal within 2 weeks. Canker sores range in size from an eighth of an inch wide in mild cases to more than an inch wide in severe cases. Severe canker sores may leave scars. Fever is rare, and the sores are rarely associated with other diseases. Usually a person will have only one or a few canker sores at a time.

Most people have their first bout with canker sores between the ages of 10 and 20. Children as young as 2, however, may develop the condition. The frequency of canker sore recurrences varies considerably. Some people have only one or two episodes a year, while others may have a continuous series of canker sores.

The cause of canker sores is not well understood. More than one cause is likely, even for individual patients. Canker sores do not appear to be caused by viruses or bacteria, although an allergy to a type of bacterium commonly found in the mouth may trigger them in some people. The sores may be an allergic reaction to certain foods. In addition, there is research suggesting, that canker sores may be caused by a faulty immune system that uses the body's defenses against disease to attack and destroy the normal cells of the mouth or tongue.

There are several treatments for reducing the pain and duration of canker sores for patients whose outbreaks cannot be prevented. The majority of these are numbing ointments such as benzocaine, which are available in drug stores without a prescription. Anti-inflammatory steroid mouth-rinses or gels can be prescribed for patients with severe sores to ease pain episodes. A significant drawback of ointments that only treat the pain of canker sores is that the do nothing to speed healing or prevent bacterial infections of the sores.

Mouth-rinses containing the antibiotic tetracycline may reduce the unpleasant symptoms of canker sores and speed healing by preventing bacterial infections in the sores. One drawback of steroid and tetracycline treatments is that they require a prescription and care of a dentist or physician. Another drawback of these treatments is that they are designed to prevent secondary bacterial infections from forming in the canker sore lesion rather than addressing the canker sore itself. A further drawback of these treatments is that some individuals have allergies to their effective ingredients.

In addition to the foregoing, prior art treatments suffer from additional drawbacks. For example, most widely available applications for treating canker sores only provide temporary pain relief. These topical applications usually cause a burning sensation at the point of contact on the canker sore and the numbing benefit is usually short-lived (less than an hour). Also, many topical applications are marketed to "promote" healing, but merely act as a barrier or provide an antibacterial agent to prevent secondary bacterial infections of the canker lesions.

The foregoing underscores some of the problems associated with prior art methods of treating mouth sores and ulcers. Furthermore, the foregoing highlights the long-felt, yet unresolved need in the art for a canker sore treatment that actually causes rapid healing. Moreover, the foregoing highlights the need in the art a non-prescription, homeopathic treatment of mouth sores and ulcers, such as canker sores. The foregoing also highlights the need in the art for an inexpensive, re-useable apparatus and method of treating mouth sores and ulcers.

IV. SUMMARY OF THE INVENTION

Various embodiments of the present invention overcome the aforementioned drawbacks in the art and offer new advantages as well. Accordingly, it is an object of the invention to provide an apparatus and method of treating the pain and/or duration of mouth sores and ulcers, particularly canker sores. It is another object of the invention to provide a non-chemical treatment for mouth sores and ulcers. It is a related object of the invention to provide an apparatus and method for the homeopathic treatment of mouth sores and ulcers, such as canker sores. It is a further object of the invention to provide an inexpensive, re-useable apparatus and method of treating mouth sores and ulcers.

These and other objects of the invention may be realized by the provision of a homeopathic treatment apparatus comprising a first portion adapted to encircle a mouth sore and a second portion adapted for communicating negative pressure to the first portion, whereby a vacuum pressure is applied to the encircled sore. In a presently preferred embodiment, the treatment device comprises a mechanism to create and release a vacuum and a conduit to deliver the vacuum in a sustained manner. A presently preferred method of treating a sore or ulcer according to the invention comprises the steps of placing the end of a vacuum tube or tip directly over the ulcer and then creating a vacuum with a vacuum generating device. After leaving the vacuum in place over the ulcer or sore for a short period of time, the vacuum is released and the treatment method is complete. The method may be repeated as necessary or desired to achieve advantageous healing results.

A treatment apparatus according to the invention achieves the surprising and unexpected results of reducing pain and dramatically accelerating healing. It is believed that a treatment apparatus used according to the methods of the invention may shorten the duration of a sore by half or more. Also, treatment provided via the present invention is much less painful than topical applications, as it does not create the stinging sensation commonly associated with their use.

Although not wishing to be bound by theory, it is presently believed that through gentle application of a vacuum to the area afflicted with a canker sore, the sensitivity of the afflicted area is diminished and the healing process is significantly improved. Specifically, it is believed that the resultant suction created by the vacuum delivers the body's inherent healing properties directly to the afflicted area while also decreasing the area's sensitivity. Thus, the pain and sensitivity of the afflicted area is reduced while the healing process is accelerated.

Another advantageous feature of the present invention is that the preferred embodiments are inexpensive to manufacture and use due to their fundamental design structure and material properties. An additional advantageous feature of the invention is that the preferred embodiments are designed to be re-useable by the provision of a cleansable or disposable vacuum applicator portions.

V. BRIEF DESCRIPTION OF THE DRAWINGS

The foregoing and other features and advantages of the invention will be apparent from the following, more particular description of preferred embodiments of the invention, as illustrated in the accompanying drawings. The drawings are to aid the understanding of advantageous features of embodiments of the invention and are not drawn to scale.

Figure 5C:
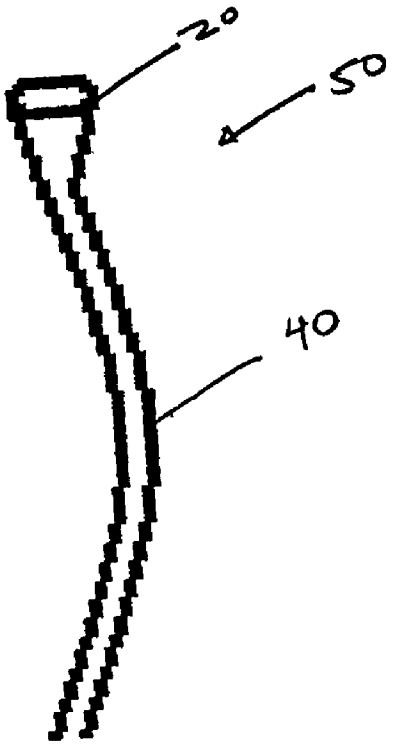
Figure 5B:
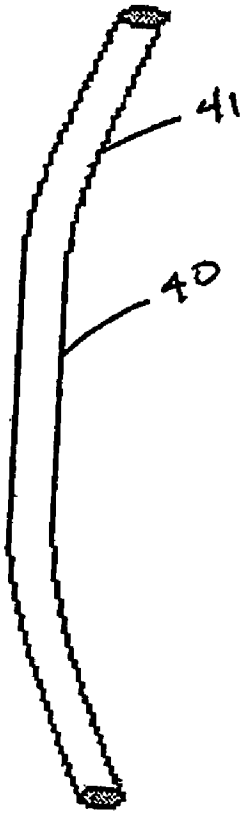
Figure 5A:
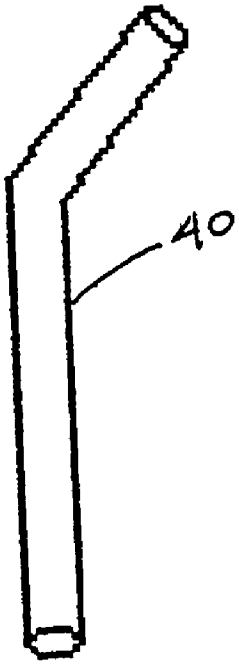

FIGS. 5A-C are side views of various embodiments of a conduit for use in a vacuum treatment device according to the invention.

Figure 6B:
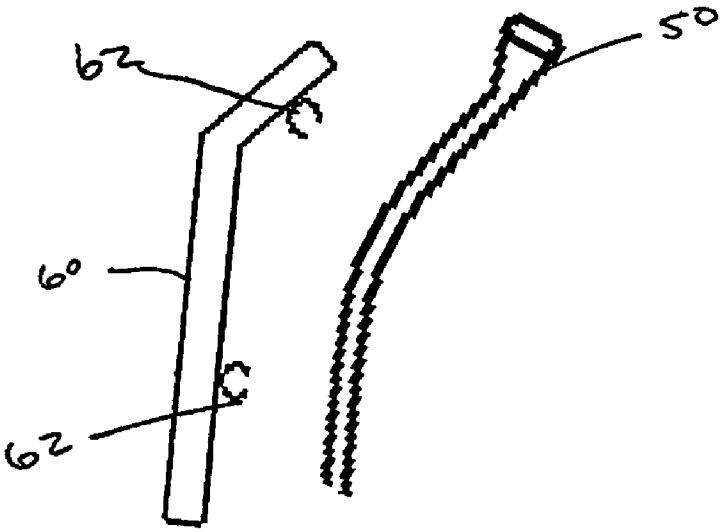
Figure 6A:
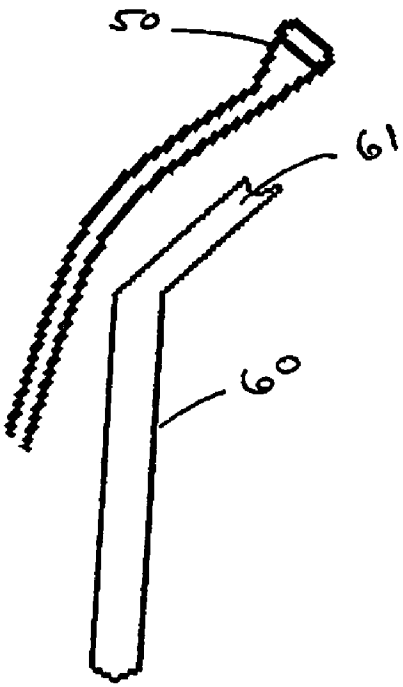

FIGS. 6A-B are side views of various embodiments of applicator holders and disposable applicators for use in a vacuum treatment device according to the invention.

Figure 7B:
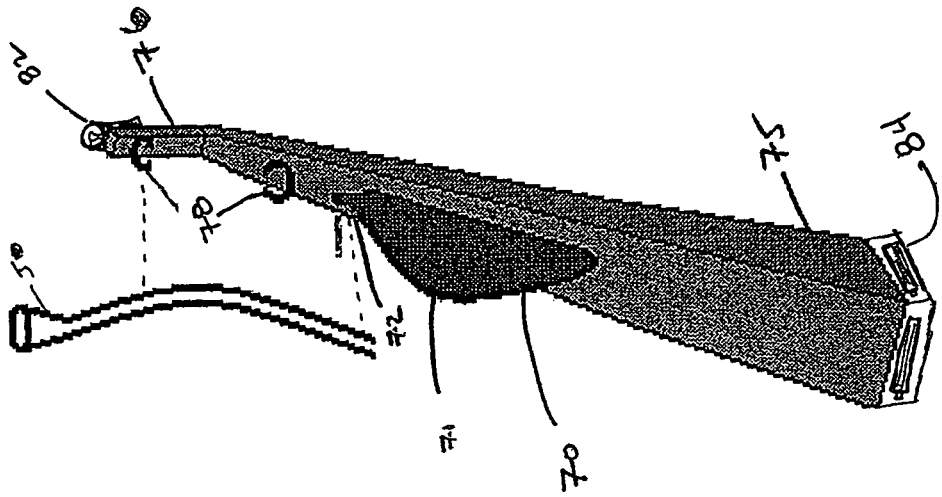
Figure 7A:
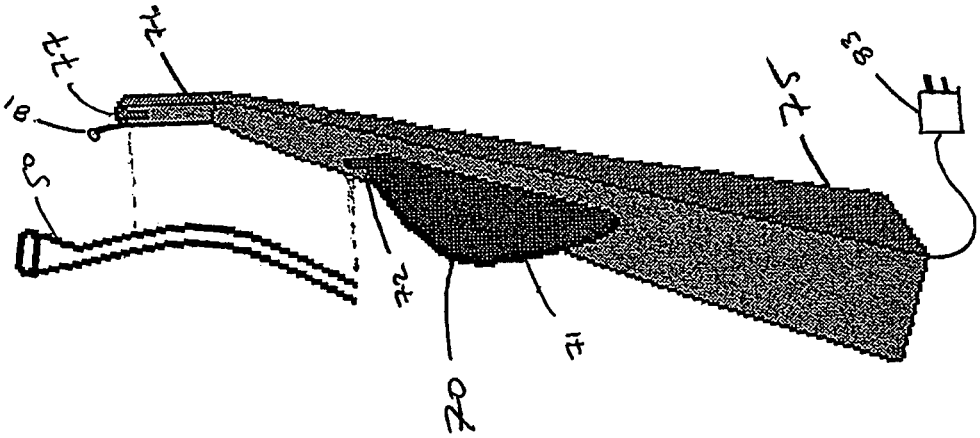

FIGS. 7A-B are perspective views of various embodiments of vacuum treatment devices according to the invention having differing means for holder an applicator.

Figure 8:
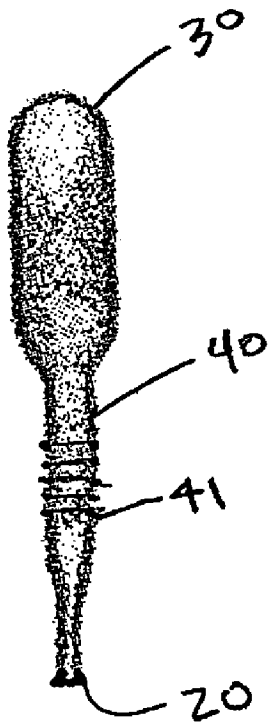

FIG. 8 depicts an embodiment of a unitary vacuum treatment device according to the invention.

VI. DETAILED DESCRIPTION

The present invention is based, in part, on the discovery that the provision of a gentle vacuum to an area afflicted with a sore may accelerate healing and reduce pain. The following detailed description relates to the alleviation of canker sores through application of a temporary, sustained vacuum to the area of the canker sore. While the present invention is described below in connection with its effectiveness in treating both pain and duration associated with canker sores, it will be readily apparent to one of ordinary skill in the art that the methods and apparatuses of the present invention may be applied to other uses in other environments. In particular, the present invention may also be applied to other types of sores, ulcers, or lesions including, but not limited to fever blisters, cold sores, and bedsores. One of ordinary skill in the art armed with the present specification will also understand that the present system and methods may be configured in numerous ways and still retain the ability to apply a desired vacuum to an afflicted area.

Figure 1:
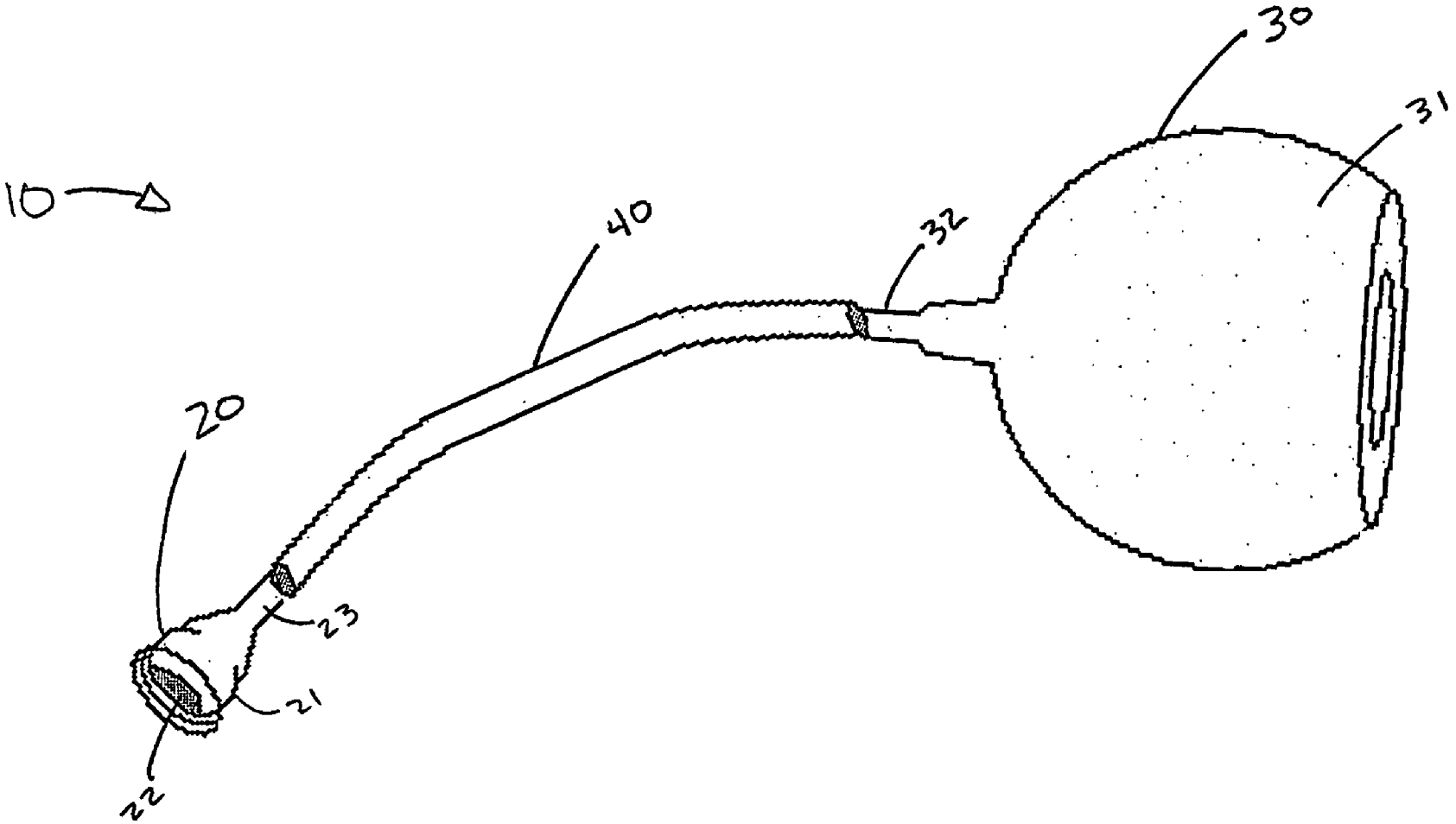
FIG. 1 is a perspective view of an embodiment of a vacuum treatment device according to the invention.

FIG. 1 depicts a representative embodiment of a vacuum treatment device that illustrates the simple construction and configuration contemplated by the invention. As shown in FIG. 1, the invention contemplates a device 100 having a tip 20 in communication with a vacuum mechanism 30, preferably (but not essential) via a conduit 40 disposed therebetween. While the conduit 40 may ultimately be formed as part of either the tip 20 or vacuum mechanism 30, or alternatively, part of a single integrated structure serving the functions of all three sections of the device 10, the use of an extended conduit 40 is preferred for the multiple reasons described below.

Given that this device is conceived to be used in a patient's mouth, suitable materials of construction presently considered include rubber, latex, vinyl, silicone, plastic or any other suitable biocompatible material. Suitable materials of construction will be readily apparent to one of ordinary skill in the art armed with the specification when contemplating which of any of the specific advantageous features of the invention described herein are to be incorporated into the device.

Figure 3:
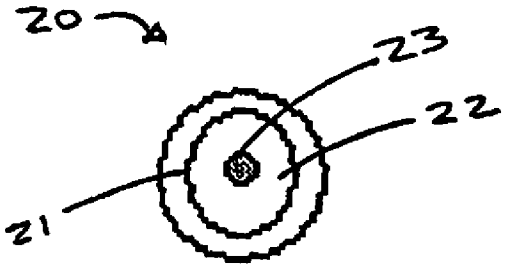
FIG. 3 is a head on view of the embodiment the sore treating tip of FIG. 2.
Figure 2:
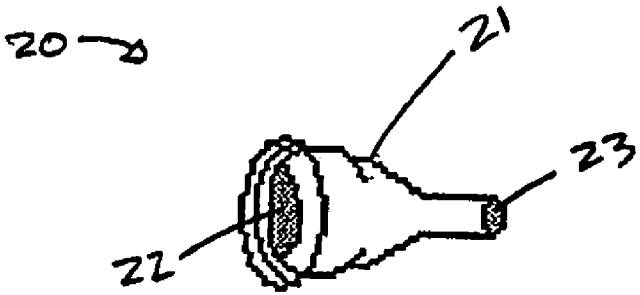
FIG. 2 is a perspective view of an embodiment of a sore treating tip member for use with the device of FIG. 1 according to the invention.

As shown in FIGS. 2 and 3, tip 20 is sized and constructed to encircle and fit directly over the area of the canker sore to apply a vacuum to the area to be treated. As best discerned from FIG. 2, tip 20 is somewhat "funnel shaped," meaning it comprises a sidewall 21 defining a large open front end, or "mouth" 22, that rapidly diminishes in size until defining a narrow tubular back end, or "throat" 23. The mouth 22 is sized to encircle the area of a canker sore, while the throat 23 is sized to form a fluid tight connection with a conduit 40, if used, or alternatively, with the vacuum mechanism 30.

Preferably, tips 20 are designed to be disposable or otherwise removed from the device 10. Removable tips 20 lends itself to the provision of different tip versions having mouths of differing circumferences for treating sores of different sizes or types. In a preferred embodiment, a kit including a vacuum mechanism, at least one conduit, and a plurality of removable tips is provided. Tips having a uniform mouth size, or preferably, differing mouth sizes, may be included in the kit.

The throat 23 of tip 20 is preferably uniform regardless of the varying circumferences of the mouth 22. A uniform throat 23 size aids in the interchangeability of tips 20 by ensuring there will be repeatable fluid-tight connection between the conduit 40 (or vacuum mechanism 30) each time a new tip 20 is used with the device. As will be appreciated by one of ordinary skill in the art, the provision of an extended tubular throat 23 section aids in the forming fluid-tight connections by providing an area to friction fit a similarly sized tube.

While the embodiment depicted in FIGS. 2 and 3 indicate a configuration wherein a conduit or fluid channel will mate with the tip by encircling the narrow, tubular throat section to form a fluid-tight seal, it may be preferable to provide the throat with an elastomeric material that allows the tip to be secured by pulling the throat over a conduit or air passageway of the vacuum mechanism. It may prove to preserve the useful life of conduit by not having to stretch it out each time a tip is mated for using the device. Devising a scheme for securing the portions of the device 10 in a manner sufficient to perform the vacuum treatment methods of the invention are well known in the art, and may include the provision of such features as barbs, snaps, threads, and the like. The invention should not be deemed limited to the method of ensuring the provision a suitable vacuum to the tip 20.

A presently preferred mechanism for supplying a vacuum to the device 10 comprises a vacuum or "pipette" bulb 30 as generally depicted in FIG. 1. A vacuum bulb 30 is an elastic, hollow body 31 having a fluid exit 32. The elastic nature of the body 31 allows it to be compressed by a user to expel the fluid within the body through the exit 32. In order to decompress and return to its original state, the body must replenish the volume of expelled fluid. In an effort to do so, as it is decompressed or controllably released from compression by the user, the body produces negative pressure or suction at the exit. This negative pressure creates a vacuum in any area depleted of fluid. The vacuum remains until the vacuum seal is broken and fluid is provided through the exit into the body in a quantity equivalent to its original volume in order to allow the ball to return to its original geometric configuration.

Figure 4:
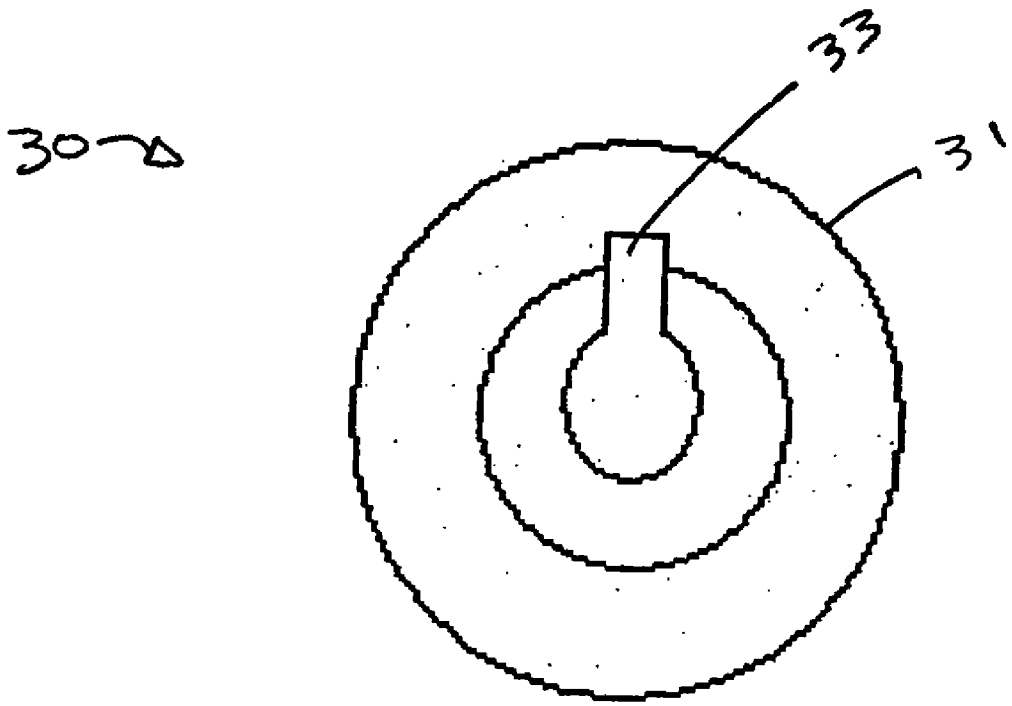
FIG. 4 is a rear view of a vacuum bulb for use with the device of FIG. 1 according to the invention.

Accordingly, the vacuum bulb 30 of this embodiment is intended to be evacuated of air by a user compressing its body 31 and then putting its exit 32 in fluid tight communication with the tip 20. The mouth 22 of tip 20 is placed in fluid tight contact with an area to be treated and then the body 31 is controllably released from compression by a user to apply vacuum pressure to the area, which remains as long as the vacuum seal with the area (and the remainder of the device 10) remains. In an alternative embodiment shown in FIG. 4, the back of the vacuum bulb 30 may be provided with an air exit 33. This air exit 33 allows a user to seal it with a digit of its hand after compression and release it to break the vacuum inside the body 32. This configuration prevents situations where the vacuum is too strong and hurts the user because the vacuum seal cannot be otherwise easily broken from attempts to remove the tip 20 from the gum of a patient or disconnect the bulb 30 or conduit 40 from each other.

The conduit 40 of the present invention may provide additional advantages apart from communicating negative pressure from vacuum bulb 30 to tip 20 to apply vacuum pressure to an area to be treated. According to one aspect of the invention, a curved or angled conduit 40 is provided. According to this aspect of the invention, the conduit serves the additional functional and ergonomic purposes of allowing a user to more easily position the tip 20 to treat a sore in the person's own or another's mouth. The conduit 40 prevents the user's hand or the vacuum bulb 30 from blocking the view into the mouth regardless of whether the viewing is done by another person or the user looking into their own mouth using a mirror. An extended conduit 40 also allows for the ease of treating remote areas of the mouth in the same manner as does the handle on a toothbrush.

As shown in FIGS. 5A and 5B, the conduit 40 can be angled in an orientation to assist in providing treatment according to the methods of the present invention. In a presently preferred embodiment, depicted in FIG. 5A, the conduit 40 comprises a resilient but deformable material. The provision of a malleable material allows the conduit to be bent into any configuration desired for treating a specific area on that occasion and then a different configuration when treating a different area on another occasion. In an alternative embodiment, depicted in FIG. 5B, the conduit 40 includes accordion compression ribs 41 which allows those sections to be expanded and held in varying orientations. These types of ribs are akin to those found on drinking straws.

In an alternative embodiment shown in FIG. 5C, the conduit 40 may be molded as a unitary piece with a treatment tip 20 to comprise a unitary applicator 50. The applicator 50 may be configured to perform any or all of the functions and purposes of the tip and conduit described in connection with other embodiments of the invention. As will be appreciated, a unitary applicator 50 may result in increased ease of use of increased useful life of the invention by not having to take the time to mating tip 20 and conduit 40 and not having to worry about losing a fluid tight seal between the tip 20 and conduit 40 through damage to the conduit from repetitive uses, improper mating, or otherwise. Preferably, the applicator 50 is designed to be removable and disposable for the advantageous interchangeability and hygienic reasons discussed herein.

An alternative embodiment of the invention which may be advantageous when using a unitary applicator 50 is shown in FIGS. 6A and 6B. According to this embodiment, the unitary applicator 50 comprises a piece of flexible tubing or other extended applicator body held in a substantially rigid position for treating an area by use of an applicator holder 60. Any suitable method of securing a conduit 40 or unitary applicator 50 with the holder 60 are understood to be contemplated by the present invention. For example, as depicted in FIG. 6A, holder 60 may comprise an angled body having a channel 61 for accepting a conduit 40 or applicator 50 body. Or as depicted in FIG. 6B, holder 60 may comprise and angled body having clips 62 for snap-fit holding of a conduit 40 or applicator 50. As will be appreciated, the holder 60 may sized, constructed, and configured to perform some or all of the advantageous features elongation of the device achieves, such as increased reach, increased visibility, malleability into different angles for different areas, etc.

Alternate embodiments of canker sore treatment devices 10 that may incorporate advantageous features according to the invention are depicted in FIGS. 7A and 7B. In accordance with these embodiments of the invention, the vacuum mechanism 30 comprises a thumb pump 70 attached to a handle 75. The thumb pump 70 includes a compressible body portion 71 and a fluid outlet nozzle 72. The thumb pump 70 operates in a manner consistent with the discussion of the vacuum pump described above. However, in this case the thumb pump 70 is actuated by the thumb of a user gripping handle 75.

Handle 75 includes a means for holding an applicator 50 in an orientation and manner sufficient to perform the treatment methods of the present invention. For example, handle 75 may have a curved neck portion 76 including the likes of a notch 77 (FIG. 7A) or clips 78 (FIG. 7B) to secure a disposable applicator 50 in communication with the nozzle 72 of the thumb pump 70 in a rigid position suitable for treating a canker sore in a patient's mouth. The handle 75 of the device with the provision of a thumb pump is contemplated to be used with disposable applicators 50 in a manner akin to razor's and disposable razor blades. As previously described, disposable applicators allow for repeated use of the device, at different times, for different size and types of sores, while ensuring proper hygiene. This embodiment of the invention also lends itself to the provision of a kit containing a handle/pump with a plurality of applicators. Additional or refill applicators may then be sold separately in various quantities, sizes, styles and combinations.

FIGS. 7A and 7B also depict other optional advantageous features that may be incorporated into embodiments of the invention. One advantageous feature is the provision of an illumination source to aid in the identification of target areas and to assist a user in proper positioning of the tip. For example, FIG. 7A includes a fiber optic light 81 for illuminating the oral cavity, while FIG. 7B shows use of a replaceable incandescent bulb 82. To provide current to power the light sources, another advantageous feature of the invention is the provision of a power source. For example, in FIG. 7A and electric plug 83 is included to allow normal 120 VAC to power the device, while FIG. 7B depicts a portable battery-charged unit using either rechargeable or disposable batteries 84.

Any suitable illumination source and/or power source, or combinations thereof, are contemplated by the invention. Likewise, as will be appreciated, if a power source is provided, the device may allow for a power-assisted vacuum to be supplied. For example, the handle 75 may include an internal or external vacuum pump to provide negative pressure to an applicator thereby negating need for the thumb pump 70. Alternatively, with a 120 VAC system, a separate vacuum pump may be provided (not shown). In addition, the device could be configured as a combination oral hygiene device which includes replaceable heads for a toothbrush, and/or a water pick mechanism, and other desired instruments. While options such as power and lighting are contemplated by the invention, a presently preferred embodiment emphasizes a low cost and simplistic construction comprising the handle 75, thumb pump 70 and a means for operatively holding a disposable applicator 50.

In addition to the embodiments discussed herein, a single unitary device 10 such as that shown in FIG. 8 is contemplated by the invention. In an embodiment of this feature of the invention, the device 10 comprises a disposable plastic body having a tip 20 extending from an elongated conduit 40 ending in a bulb 30. The conduit or shaft 40 may include an accordion compression section 41 of the type previously described to provide for the optimal positioning of the device during use. In operation, the bulb 30 is compressed, the tip 20 placed over the sore area, and the bulb 30 released to create a vacuum on the sore area. Once a sufficient time has elapsed, the device 10 is removed and discarded. Depending on the sizing, the bulb 30 may be provided with a pin hole (not shown) to allow the vacuum to be broken and the device safely removed. The device may also be sized, constructed and configured to achieve other advantageous features of the invention as previously described herein. The present invention contemplates a kit containing a plurality of unitary devices 10 each having a vacuum bulb section, a conduit section, and a tip. The devices may be packaged in individual sterile packaging or in a sterile packaging housing multiple devices, akin to band-aids in a box. The devices may be provided in packages that include a plurality of devices having a uniform tip size, or alternatively, in packages having a plurality of devices having different tip sizes for treating different sized sores. Any alternate combination of devices in a bulk package should be understood as being contemplated by the invention.

According to the invention, a preferred method of treating a canker sore using any of the embodiments of the invention previously described comprises positioning the tip of the device in an orientation to create a vacuum seal in an area to be treated, applying a vacuum to the area to be treated for 30 seconds to one minute, and releasing the vacuum. Multiple treatments per day may be completed to maximize results. The treatment times and frequency may vary depending on the individual user, vacuum applied, nature of the area to be treated, and the injury to the area.

If performed properly, the resultant suction created by the vacuum of the methods of the present invention delivers the body's inherent healing properties directly to the afflicted area. Correspondingly, the pain and sensitivity of the afflicted area is reduced while the healing process is accelerated. Healing of up to two times as fast is believed to achievable.

Although shown and described is what is believed to be the most practical and preferred embodiments, it is apparent that departures from specific designs and methods described and shown will suggest themselves to those skilled in the art and may be used without departing from the spirit and scope of the invention. The present invention is not restricted to the particular construction described and illustrated, but should be constructed to cohere with all modifications that may fall within the scope of the appended claims.

I claim:

1. A method for treating sores in the mouth of a patient comprising: providing an apparatus comprising:

a manual vacuum device configured to repeatedly create a sustained vacuum and repeatedly release the sustained vacuum;

a flexible and malleable conduit having first and second ends, the first end being affixed to the manual vacuum device, wherein a fluid tight seal is created between the manual vacuum device and the flexible and malleable conduit, said conduit including accordion compression ribs which allow said conduit to be expanded and held in varying orientations; and a funnel shaped structure releasably affixed to the second end of the flexible and malleable conduit, wherein a fluid tight seal is created between the funnel shaped structure and the flexible and malleable conduit, the funnel shaped structure including a sidewall defining a first open end sized to fit over a canker sore in an oral cavity of a living organism and a narrow throat for connection to the flexible and malleable conduit, the manual vacuum device and the flexible and malleable conduit being sized for substantially complete placement within the oral cavity of a patient while allowing an individual to see within the oral cavity for both proper placement of the funnel shaped structure and manipulation of the manual vacuum pump device with a single hand; using the manual vacuum device to create a vacuum seal between the funnel shaped structure and an effected area in the mouth; and breaking the vacuum seal.

* * * * *